United States Patent [19]

Glinka et al.

[11] 4,380,316

[45] Apr. 19, 1983

[54] ELECTRONIC INTERLOCK FOR A CASH COLLECTION RECEPTACLE

[75] Inventors: John S. Glinka, Elk Grove Village; Larry E. Zack, Cary, both of Ill.

[73] Assignee: Qonaar Corporation, Elk Grove Village, Ill.

[21] Appl. No.: 283,228

[22] Filed: Jul. 14, 1981

[51] Int. Cl.[3] ..... G05F 9/06

[52] U.S. Cl. ..... 232/16; 232/43.2

[58] Field of Search ..... 232/15, 16, 7, 43.2

[56] References Cited

U.S. PATENT DOCUMENTS

| | | | |
|---|---|---|---|
| Re. 28,307 | 1/1975 | Dominick et al. | 232/7 |
| Re. 28,308 | 1/1975 | Dominick et al. | 232/16 |
| 3,677,461 | 7/1972 | Nitschneider et al. | 232/43.2 X |
| 3,693,870 | 9/1972 | Dominick et al. | 232/16 |
| 3,795,417 | 3/1974 | Cohen | 232/15 X |
| 3,944,976 | 3/1976 | France | 340/146.2 |
| 3,966,116 | 6/1976 | Dominick et al. | 232/7 |

*Primary Examiner*—Robert P. Swiatek

*Attorney, Agent, or Firm*—McDougall, Hersh & Scott

[57] ABSTRACT

An electronic interlock for providing improved security in a revenue collection receptacle includes a mechanism on a removable cash container for generating a coded electronic signal which is coupled to a mechanism for decoding the coded signal mounted to the receptacle, and a mechanism responsive to the decoding mechanism which prevents revenue from being transferred to the cash container unless the decoding mechanism detects the presence of the coded electronic signal.

17 Claims, 7 Drawing Figures

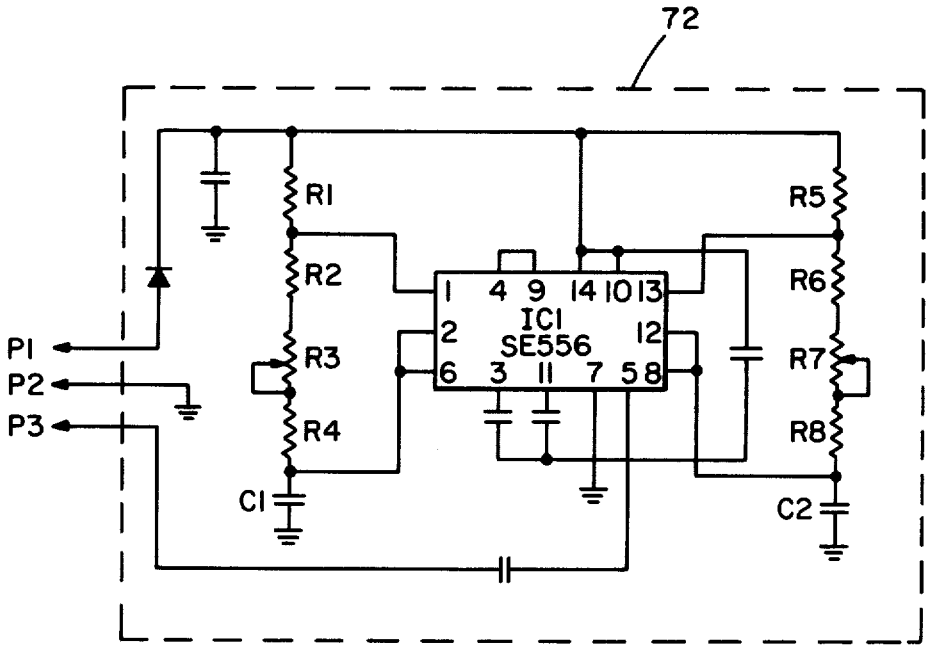
FIG.6
FIG.7
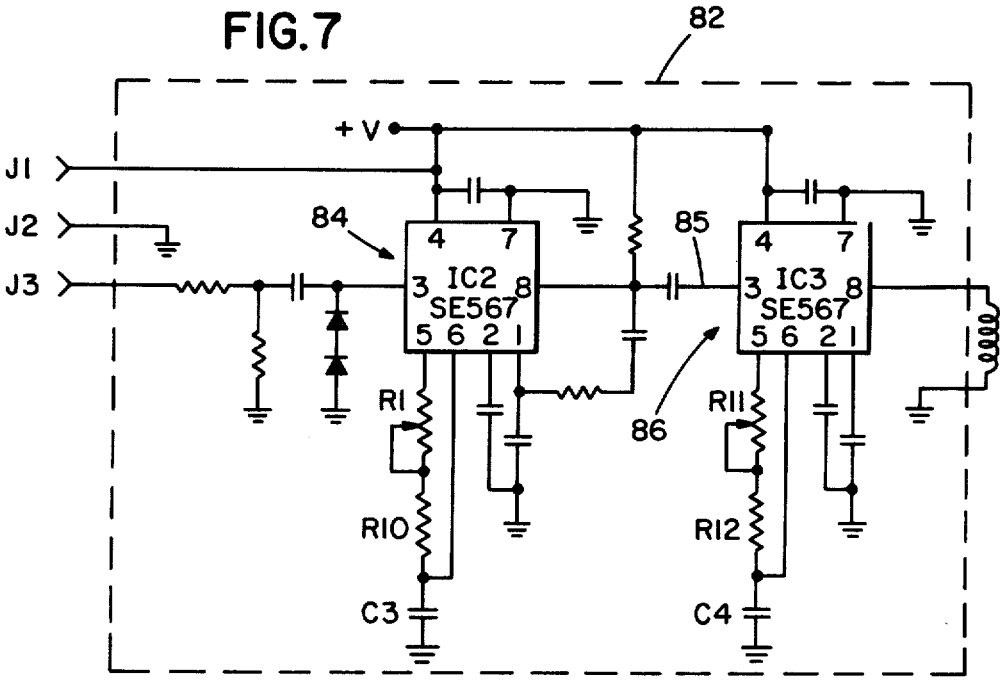

ELECTRONIC INTERLOCK FOR A CASH COLLECTION RECEPTACLE

BACKGROUND OF THE INVENTION

This invention relates generally to the field of collection receptacles designed for receiving and storing cash, and more specifically relates to the security of collection receptacles which store fares collected by a mass transit system or the like. The word "cash" as used herein includes coins, currency, tokens and tickets.

In a mass transit system, passengers deposit cash into fareboxes located on a vehicle such as a bus or at an entrance gate to a railroad transit facility. Typically, each farebox has a container referred to as a cash box, for storing the fares. The cash boxes must be emptied from time to time, usually at a central collection center where the receipts are tabulated and the currency forwarded to a bank for deposit.

U.S. Pat. No. 3,966,116, entitled "Security Box and Receptacle Housing for Valuables" and assigned to the same assignee as the present invention, discloses a removable cash box to which access is automatically closed upon removing the cash box from the farebox housing. This patent also discloses an acceptance or central collection receptacle having a compartment designed to receive the cash box and having a mechanism designed to open the cash box thereby emptying the contents of the latter into the receptacle. Additional patents assigned to the assignee of this invention which disclose collection receptacles include U.S. Pat. Nos. Re. 28,307 entitled "Exact Fare System" and Re. 28,308 entitled "Cash Acceptance Receptacle".

It is known to provide a central collection receptacle with a removable container or vault for storing the fares discharged from the cash boxes. Such a vault which is full of revenue can be removed from the collection receptacle and another vault installed so that the transfer of revenue from the cash boxes can continue while the full vault is being transported to a bank or other location to be emptied. Similarly, full cash boxes in a farebox can be removed and replaced to permit continuous operation.

While the interchangeability of cash boxes and vaults adds to the efficiency and continuity of operation of revenue collection, security must be maintained to minimize the possibility of theft. Especially with a central collection receptacle, it is desirable that the contents of the cash boxes can not be discharged unless a vault is in operative position within the receptacle to receive the revenue. This prevents the theft of revenue which might occur by dumping the contents of the cash box into the compartment normally occupied by the vault. Preferably only a selected set of vaults can be used with each collection receptacle to prevent theft by substituting an unauthorized vault of similar mechanical construction and discharging the contents of the cash boxes into such a vault.

It is a general object of this invention to provide an electronic interlock between a collection receptacle and its removable cash container thereby providing improved security.

It is a more specific object of this invention to provide an electronic interlock between a collection receptacle and a removable vault with utilizes a coded electronic signal whereby authorized and unauthorized vaults can be distinguished.

SUMMARY OF THE INVENTION

This invention relates generally to an improvement in a collection receptacle having a removable vault of revenue holding container wherein an electronic interlock between the vault and collection receptacle provides increased security against theft. Collection receptacles are particularly, but not exclusively, suited for use in mass transit systems to receive and store fares collected in individual cash boxes. The collection receptacle includes a compartment for receiving a removable vault which stores the revenue or cash deposited in the receptacle. The improvement aspects of the present invention include a means carried by the vault for generating a coded electronic signal, which is coupled to decoding means mounted to the receptacle for detecting the coded electronic signal, and means responsive to the decoding means for preventing the transfer of revenue to the vault except upon the detection of the coded signal.

BRIEF DESCRIPTION OF THE DRAWINGS

FIG. 6 is a schematic diagram of a coded electronic signal generator.

FIG. 7 is a schematic diagram of a decoder for decoding or detecting the coded electronic signal.

GENERAL STRUCTURE AND OPERATION OF A COLLECTION RECEPTACLE

Although the electronic interlock of the present invention is suitable for use with any type of collection receptacle having a removable cash container, the general structure and operation of an exemplary central collection receptacle 10 is explained to provide a background for the present invention.

Figure 1:
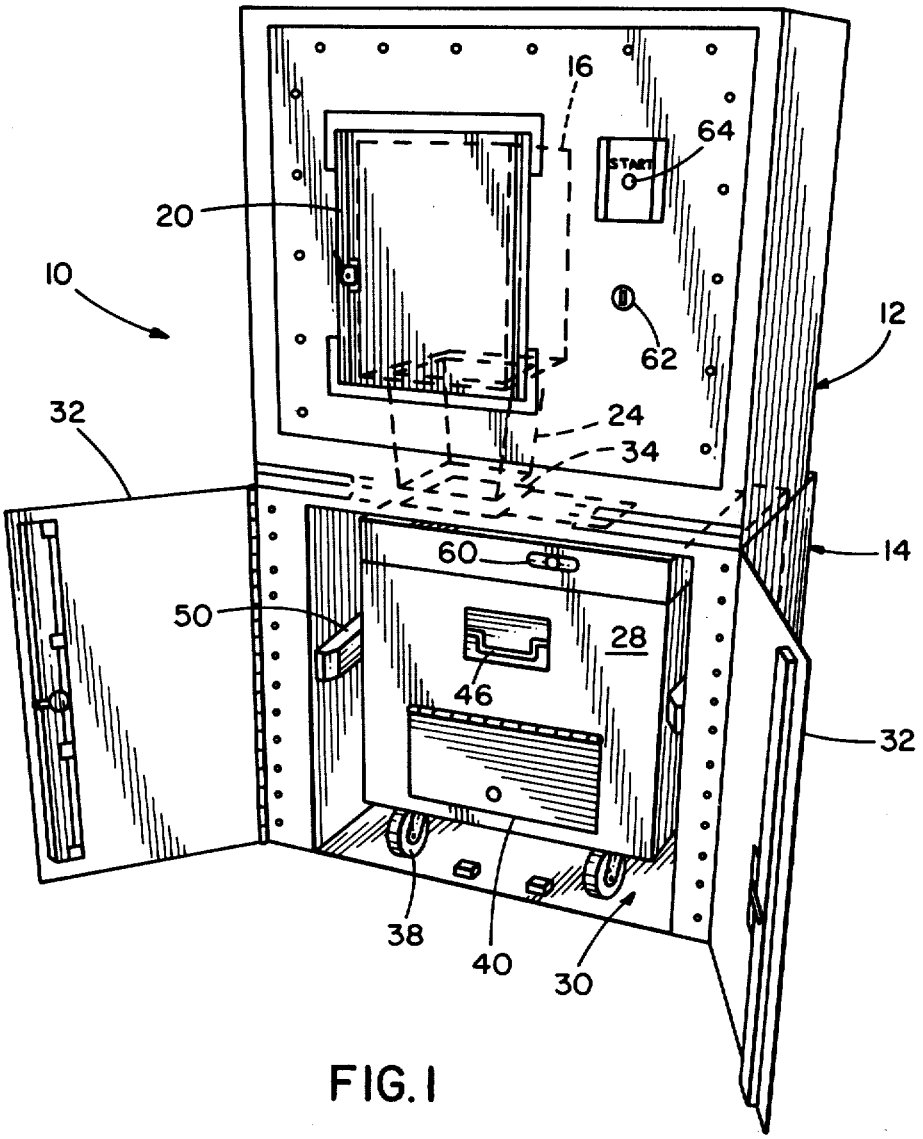
FIG. 1 is a perspective view of a collection receptacle.
Figure 4:
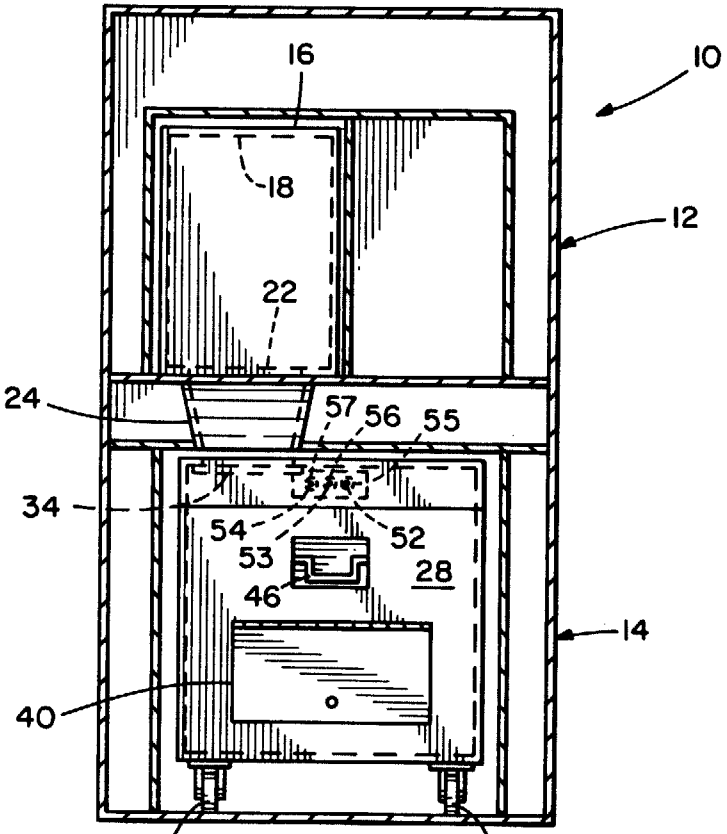
FIG. 4 is a cross-sectional front view similar to FIG. 3.
Figure 3:
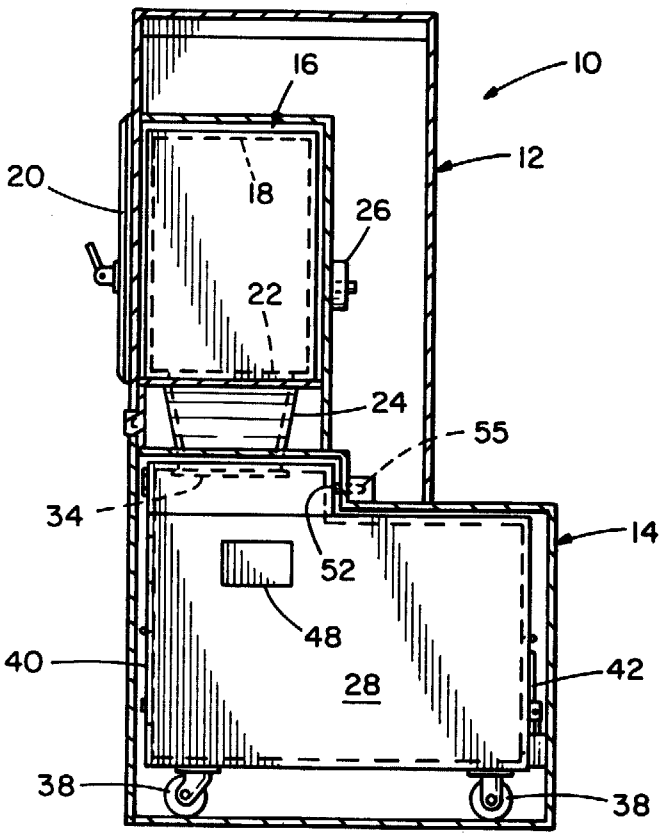
FIG. 3 is a cross-sectional side view of the collection receptacle showing the vault in position to receive revenue.

As seen in FIGS. 1, 3 and 4, the illustrative collection receptacle 10 has an upper portion 12 and a lower portion 14. Compartment 16 in the upper portion receives a cash box 18 which is locked therein by means of a door 20. The cash box has a bottom door 22 disposed above the upper end of chute 24. The upper portion 12 contains a mechanism for opening the bottom door 22 of the cash box to allow the contents thereof to be discharged into chute 24 upon activation of this mechanism. The cash box and the mechanism for opening same may be of a structure similar to the apparatus as disclosed in U.S. Pat. No. 3,966,116, entitled "Security Box and Receptacle Housing For Valuables", which is assigned to the same assignee as the present invention, and which is incorporated by reference herein. Although the cash box opening mechanism may be manually operated, an electric motor 26 is preferably provided to drive the opening mechanism through an opening and closing cycle.

Figure 2:
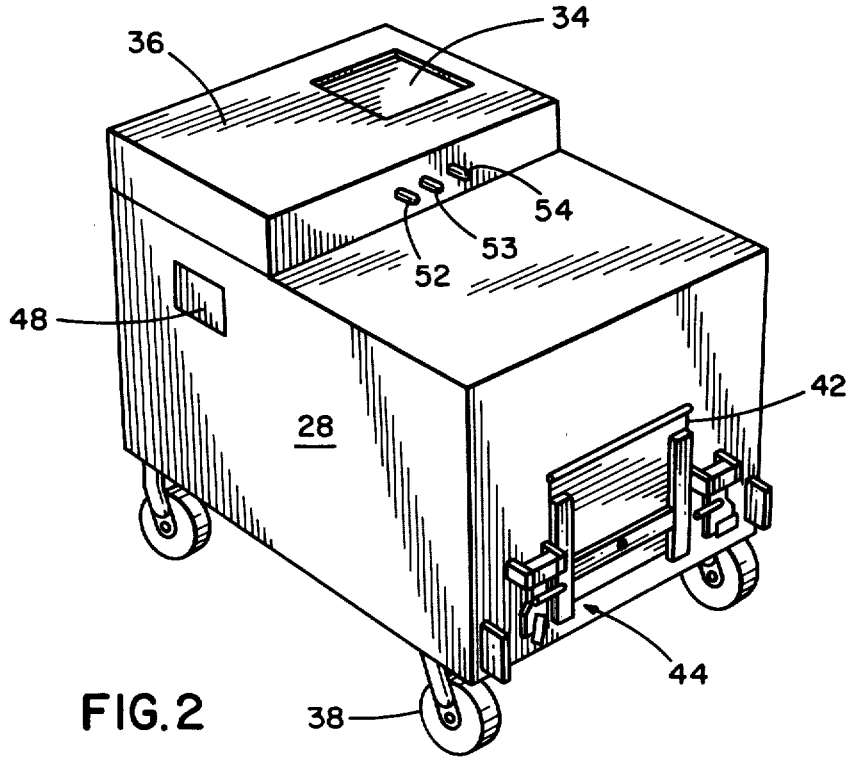
FIG. 2 is a perspective view of a mobile vault.

FIG. 1 illustrates mobile vault 28 in its operative position within compartment 30 of the lower portion 14 of the collection receptacle. Doors 32 prevent access to chamber 30 during the transfer of revenue from the cash box to the vault 28. A slidable door or shutter 34 on the vault, note FIG. 2, normally blocks the cash receiving opening in the top of the vault which is disposed in alignment below the lower end of chute 24 when in is operative position. The top portion 36 of the vault contains a mechanism for opening and closing shutter 34 which may be of a similar structure to that shown in U.S. Pat. No. 3,966,116. A handle 60 can be used to control the shutter mechanism.

The vault is easily moved into and out of compartment 30 by means of wheels 38. A front door 40 and rear door 42 each have a conventional lock for securing same and provide a means for accessing the interior of the vault to remove the cash stored therein. An adjustable gate assembly 44 can be used to permit door 42 to be opened slowly so as to control the rate of discharge of cash contained in the vault. The vault also contains a handle 46 for moving the vault and a window 48 of a high security type to permit a visual inspection of the interior of the vault.

A pair of guides 50 on the side walls defining compartment 30 insures that the vault 28 will enter into compartment 30 in proper alignment so that electrical connection pins 52, 53 and 54 projecting from the vault will engage corresponding jacks 55, 56 and 57 which are fixedly mounted within lower portion 14. These electrical pins and jacks provide electrical continuity between circuitry contained within the upper portion 36 of vault 28 and circuitry contained within the collection receptacle as will be described subsequently with respect to the electronic interlock.

A typical operational cycle of the collection receptacle is initiated by rolling an empty vault 28 into its operational position within vault 30 as shown in FIG. 1. Front door 40 and rear door 42 of the vault are closed and locked and shutter 34 is blocking the cash access opening to the vault. Shutter 34 is moved from its position blocking the cash receiving opening by turning handle 60. Doors 32 are now closed and secured by means of a conventional lock.

A cash box 18 containing the collected revenue is placed within compartment 16 and door 20 closed. The mechanism in upper portion 12 engages the bottom door 22 of the cash box and is driven by motor 26 to open the door 22 allowing the revenue within the cash box to discharge through chute 24 into vault 28. An electrical locking switch 62 and start switch 64 may be used to control motor 26. After a length of time sufficient to allow the contents of the cash box to be emptied, the motor may be operated to close the bottom door 22 of the cash box. During the transfer of cash, door 20 is preferably engaged by a conventional mechanical interlock so that it cannot be opened until the door of the cash box is again closed. Door 20, after the cash box has been emptied, is opened and the empty cash box is removed. In a like manner, additional cash boxes are emptied by means of the collection receptacle.

When the vault 28 is full, or after a given number of cash boxes have been emptied, the vault is ready to be removed from the collection receptacle. Doors 32 are unlocked and opened allowing access to handle 60 which is rotated thereby causing shutter 34 to move into a blocking position closing access to the vault. Handle 46 may then be utilized to pull vault 28 from compartment 30 and transport it to another location such as to an armored vehicle for transportation to a bank. Preferably the mechanism controlling the shutter 34 includes a lock which prevents unauthorized access to the vault. A second empty vault can be positioned within the collection receptacle so that revenue collection can continue.

ELECTRONIC INTERLOCK

Figure 5:
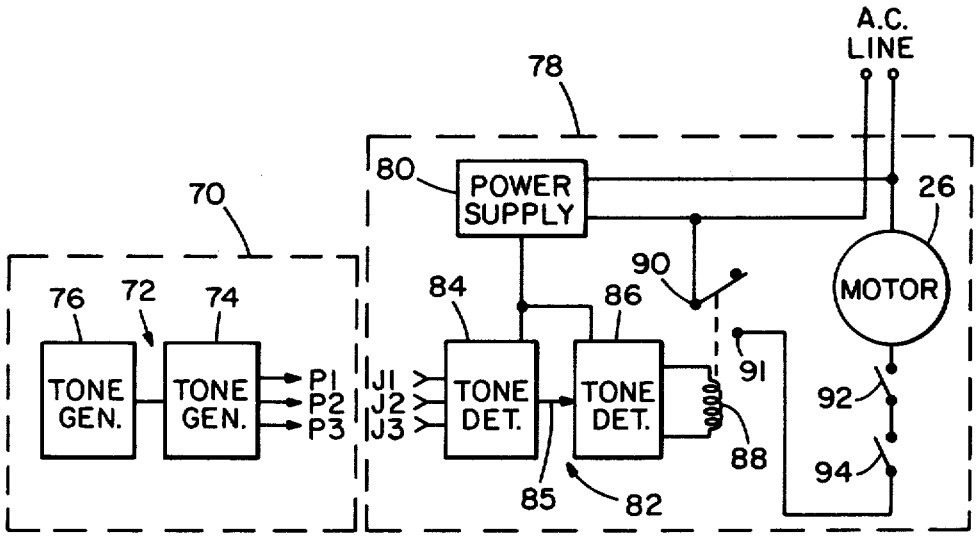
FIG. 5 is a diagrammatic representation of an embodiment of an electronic interlock.

An electronic interlock of the present invention, as shown diagrammatically in FIG. 5, utilizes a coded electronic signal to distinguish vaults which are authorized for use with a particular collection receptacle. In addition to discriminating between authorized and unauthorized vaults, the used of a coded electronic signal as an electronic interlock provides an additional measure of security.

Vault 28, which is represented in FIG. 5 as numeral 70, contains a transmitter 72 for generating a coded electronic signal having a predetermined code. Transmitter 72 may consist of an astable multivibrator (or tone generator) 74 which generates a carrier frequency which is modulated by a lower frequency tone generated by tone generator 76. Thus the coded electronic signal produced by transmitter 72 comprises two distinguishable separate frequency components.

The schematic diagram of a suitable transmitter 72 is shown in FIG. 6 wherein a single integrated circuit IC 1, such as an SE 556 available from Signetics Corp., contains two tone generating circuits. IC 1 is utilized as a tone burst generator, that is, the tone generated by tone generator 74 is turned on and off at a rate corresponding to the frequency of tone generator 76. The frequency of tone generator 74 is determined by the RC time constant of resistors R1–R4 and C1; the frequency of modulating tone generator 76 is determined by the RC time constant of resistors R5–R8 and C2. For example, a carrier frequency could be selected in the range of 20 KHz–100 KHz and a modulating frequency in the range of 200–5000 Hz. Electrical connections with transmitter 72 are provided by electrical contaction pins 52–54, note FIG. 2, which correspond respectively to connections P1–P3. P1 provides the transmitter with a positive DC supply voltage, P2 supplies a common ground return, and p3 couples the coded electrical output signal of transmitter 72 to receiver 82.

In FIG. 5, the collection receptacle 10 is represented diagrammatically as numeral 78 and includes a conventional DC power supply 80 which supplies receiver 82 and transmitter 72 with DC voltage. Reciver 82 provides a means for decoding an electronic signal having a predetermined code, i.e. it detects if such a signal is being received. If a corresponding coded signal is received, an electromechanical device 88, such as a relay, is energized. The relay contacts 90, 91 function as a switch in series with motor 26 thereby preventing the motor from operating unless the proper signal is received. Series switches 92 and 94 correspond respectively to electronic lock switch 62 and a start switch 64, note FIG. 1. A vault having a transmitter 72 which produces the two preselected frequencies is required before power can be applied to motor 26. Therefore, collection receptacle 10 will not function to discharge cash from the cash box unless an authorized vault is utilized, i.e. one having a transmitter that generates the proper signal.

Receiver 82 can be comprised of a tone detector 84 for detecting the presence of a tone having a frequency which corresponds to the carrier frequency generated by tone generator 74. The output 85 of detector 84 provides the input to tone detector 86. Since the output 85 of detector 84 varies with the presence or absence of the tone generated by generator 74, output 85 varies at a frequency corresponding to the modulating frequency of tone generator 76. Tone detector 86 is tuned to select a signal having a frequency equal to that generated by tone generator 76. Therefore, a signal containing both the selected carrier frequency and modulating frequency must be received before the collection receptacle can function.

In FIG. 7, receiver 82 is shown schematically wherein tone detector 84 comprises IC2 and tone detector 86 comprises IC3. These integrated circuits are phase locked loop tone decoders such as SE 567 available from Signetics Corp. Components R9, R10, C3 and R11, R12, C4 determine the center frequency to which tone detectors 84 and 86 are tuned, respectively.

Although the specific electronic signal employed in the described embodiment utilizes a frequency type of coding, various other types of coded electronic signals could be employed. For example, a coded electronic signal based upon amplitude modulation, frequency modulation, pulse code modulation, or combinations thereof could be utilized to produce a unique electronic signal. Also the coded electronic signal generated by the transmitter could be broadcast by an appropriate antenna to a suitable receiver for wireless operation; in this case the transmitter could be furnished with an independent power supply thereby eliminating the need for electrical connections between the transmitter and receiver.

As an alternative to providing a relay having switch contacts connected in series with motor 26, the output of receiver 82 could be utilized to activate a solenoid which could seve as a mechanical interlock to prevent the discharge of revenue from the cash container. A solenoid operated mechanical interlock could be employed with a collection receptacle requiring manual revenue transfer, i.e. not motor driven.

It will be understood that various changes and modifications may be made in the embodiment described above to provide the characterisics of the present invention without departing from the spirit thereof, particularly as defined in the following claims.

What is claimed is:

1. In a collection receptacle for receiving cash, said receptacle of the type including a removable cash receiving vault positioned within a compartment therein, the improvement in an electronic interlock comprising:

(a) means for generating a coded electronic signal having a predetermined code;

(b) means for decoding said coded electronic signal, said decoding means responsive only to said coded electronic signal having said predetermined code, one of said generating means and decoding means disposed on said vault and the other disposed on said collection receptacle;

(c) means for coupling said signal from the generating means to the decoding means, said coupling means comprising a set of electrical connection pins and a set of jacks for receiving said pins, one of said sets mounted on said vault and the other set mounted on said receptacle so that said pins engage said jacks when said vault is positioned within said compartment;

(d) means responsive to said decoding means for preventing cash from being deposited in said removable vault except when said decoding means detects said coded electronic signal having said predetermined code.

2. The apparatus according to claim 1 wherein said generating means is disposed on said vault and electrical power to operate said generating means is coupled to the latter via certain of said pins and jacks.

3. In a collection receptacle for receiving revenue from a cash box, said receptacle including a first compartment for receiving the cash box, a second compartment, a removable vault positioned within the second compartment to receive the revenue for the cash box, and means for transferring the revenue from the cash box to the vault, the improvement in an electronic interlock comprising:

(a) means carried by said removable vault for generating a coded electronic signal having a predetermined code;

(b) means coupled to said receptacle for decoding said coded electronic signal, said decoding means responsive only to said coded electronic signal having said predetermined code;

(c) means for coupling said signal of the generating means to said decoding means; and (d) means responsive to said decoding means for preventing said transferring means from transferring revenue from said cash box except when a coded electronic signal having said predetermined code is detected by said decoding means.

4. The apparatus according to claim 3 wherein said generating means generates an electronic signal having a first and a second frequency component.

5. The apparatus according to claim 4 wherein said decoding means includes a first means for decoding said first frequency component and a second means for decoding said second frequency component.

6. The apparatus according to claim 5 wherein said second means is connected in series with said first means.

7. The apparatus according to claim 3 wherein said coupling means comprises a set of electrical connection pins and a set of jacks for receiving said pins, one of said sets mounted on said vault and the other set mounted on said receptacle so that said pins engage said jacks when said vault is positioned within said compartment.

8. The apparatus according to claim 7 wherein electrical power to operate said generating means is coupled to the latter via certain of said pins and jacks.

9. In a collection receptacle for receiving cash, said receptacle of the type including a removable cash receiving vault positioned within a compartment therein, the improvement in an electronic interlock comprising:

(a) means for generating a coded electronic signal having a predetermined code;

(b) means for decoding said coded electronic signal, said decoding means responsive only to said coded electronic signal having said predetermined code, one of said generating means and decoding means disposed on said vault and the other disposed on said collection receptacle;

(c) means for coupling said signal from the generating means to the decoding means;

(d) means responsive to said decoding means for preventing cash from being deposited in said removable vault except when said decoding means detects said coded electronic signal having said predetermined code, said preventing means comprising an electromechanical device responsive to said decoding means and an electric motor, said electromechanical device being a relay having contacts connected in series with said motor.

10. The apparatus according to claim 9 wherein said coupling means comprises a set of electrical connection pins and a set of jacks for receiving said pins, one of said sets mounted on said vault and the other set mounted on said receptacle so that said pins engage said jacks when said vault is positioned within said compartment.

11. The apparatus according to claim 10 wherein said generating means is disposed on said vault and electrical power to operate said generating means is coupled to the latter via certain of said pins and jacks.

12. In a collection receptacle for receiving cash, said receptacle of the type including a removable cash receiving container positioned within a compartment therein, the improvement in an electronic interlock comprising:

(a) means for generating a coded electronic signal having a predetermined code;

(b) means for decoding said coded electronic signal, said decoding means responsive only to said coded electronic signal having said predetermined code, one of said generating means and decoding means disposed on said container and the other disposed on said collection receptacle;

(c) means for coupling said signal from the generating means to the decoding means, said coupling means comprising a first and second set of electrical contacts mounted to said receptacle and container, respectively, the contacts of said first set engaging the contacts of said second set when said container is positioned within said compartment;

(d) means responsive to said decoding means for preventing cash from being deposited in said removable container except when said decoding means detects said coded electronic signal having said predetermined code.

13. The apparatus according to claim 12 wherein electrical power to operate said one of said generating means and decoding means disposed on said container is coupled to said one via certain of said engaged contacts of said first and second sets of contacts.

14. The apparatus according to claim 12 wherein said preventing means includes an electric motor mounted to said receptacle.

15. In a collection receptacle for receiving cash, said receptacle of the type including a compartment for receiving a removable cash box having a door for restricting access to cash contained therein, the improvement in an electronic interlock comprising:

(a) means for generating a coded electronic signal having a predetermined code;

(b) means physically separate from said generating means for decodng said coded electronic signal, said decoding means responsive only to said coded electronic signal having said predetermined code;

(c) separable means for coupling said signal from the generating means to the decoding means; and (d) means, responsive to said decoding means detecting said coded electronic signal having said predetermined code, for opening said door.

16. The apparatus according to claim 15 wherein said opening means includes an electric motor coupled to said door for opening the latter.

17. The apparatus according to claim 16 wherein said electric motor is coupled to said door to control the opening and closing of the door.

* * * * *